United States Patent [19]

DeSousa

[11] 4,243,218

[45] Jan. 6, 1981

[54] HOPPING VEHICLE

[76] Inventor: Egas J. DeSousa, 6152 E. Knoll, Flint, Mich. 48507

[21] Appl. No.: 13,459

[22] Filed: Feb. 21, 1979

[51] Int. Cl.[3] ..... A63B 25/08

[52] U.S. Cl. ..... 272/114

[58] Field of Search ..... 272/114, 70.1; 180/7 R; 267/20 R, 166, 177; 280/1.11 R, 12 H, 12.1, 1.181, 1.182

[56] References Cited

U.S. PATENT DOCUMENTS

| | | | |
|---|---|---|---|
| 2,793,036 | 5/1957 | Hansburg | 272/114 |
| 3,110,492 | 11/1963 | Hoffmeister | 272/114 X |
| 3,181,862 | 5/1965 | White | 272/114 |
| 3,351,342 | 11/1967 | Guin | 272/114 |
| 3,614,084 | 10/1971 | Brown | 272/114 X |
| 3,765,693 | 10/1973 | Morrison et al. | 272/114 X |
| 3,773,320 | 11/1973 | Samiran et al. | 272/114 |

FOREIGN PATENT DOCUMENTS

| | | | |
|---|---|---|---|
| 2643730 | 3/1978 | Fed. Rep. of Germany | 272/114 |

*Primary Examiner*—Richard J. Apley
*Attorney, Agent, or Firm*—Gifford, VanOphem, Sheridan & Sprinkle

[57] ABSTRACT

A hopping vehicle is provided comprising an elongated frame having a lower end adapted to engage a ground supporting surface and having handle bars secured to its upper end. A pair of elongated foot levers are pivotally secured at one end to a horizontal carriage assembly longitudinally slidably mounted to the frame near its lower end. A stirrup for supporting an operator's foot is secured to the opposite end of each foot lever. The first end of each foot lever is selectively connected to a gear segment which when connected, rotates in unison with the foot lever. Each gear segment in turn meshes with a stationary gear rack secured to the frame. An elongated helical spring is disposed between the upper end of the gear rack and a spring retainer longitudinally slidably mounted on and near the top of the frame. Connecting bars connect the carriage assembly to the spring retainer so that pivotal action of the foot levers from their upper and to their lower position forces the retainer longitudinally downwardly and toward the gear rack thus compressing the helical spring between the retainer and the gear rack. A release mechanism, which can be either automatically controlled upon engagement of the hopping vehicle with the ground or manually controlled by the operator, disengages the gear segments from the foot levers which permits the spring to expand and provide the propulsion power for the hopping vehicle.

10 Claims, 4 Drawing Figures

HOPPING VEHICLE

BACKGROUND OF THE INVENTION

I. Field of the Invention

The present invention relates generally to vehicles and, more particularly, to an improved manually powered hopping vehicle.

II. Description of the Prior Art

There have been a number of previously known hopping vehicles, commonly known as pogo sticks. Typically, these previously known pogo sticks comprise an elongated vertical frame having a lower end adapted to engage the ground while handle means are secured to the upper end of the frame.

The propulsion means for these previously known pogo sticks all operate in a similar manner and comprise a horizontal carriage member which is vertically slidably mounted to the pogo stick frame and has a pair of foot rests secured to it. The carriage member, however, is urged towards an upper position by a spring which compresses as the weight of the user is applied to the foot rest. In operation, the spring is reciprocally compressed and decompressed by the weight of the user applied to the foot rests and during the hopping action of the pogo stick.

One disadvantage of the previously known pogo sticks, however, is that the stiffness of the spring, and therefore, the propulsion power of the pogo stick is limited by the weight of the user as applied to the foot rests. Consequently, both the jumping height of the pogo stick and the maximum lineal distance obtainable between jumps is necessarily limited. For this reason, the previously known pogo sticks have been employed primarily as toys by youngsters and have not been considered as a serious transportation means.

SUMMARY OF THE PRESENT INVENTION

The present invention provides a self-propelled hopping vehicle with novel means for increasing the spring stiffness and thus the hopping height and distance traveled by the vehicle.

In brief, the hopping vehicle according to the present invention comprises an elongated frame having a lower end adapted to engage a ground support surface and a handle bar secured to its upper end. A carriage assembly is longitudinally slidably mounted to the frame near its lower end. While a pair of elongated foot levers is pivotally secured at one end to the carriage assembly, a foot stirrup is secured to the other end of each foot lever and the foot levers are pivotally movable from an upper and to a lower position.

The carriage assembly also carries a pair of gear segments and means are provided for selectively connecting the gear segments to the foot levers so that the gear segments rotate in unison with the pivotal action of the foot levers from their upper and to their lower position. The gear segments in turn mesh with a gear rack secured to the vehicle frame and near its lower end. Thus, as the foot levers are pivoted from their upper to their lower position, the carriage assembly moves longitudinally downwardly along the frame due to the coaction of the gear segments with the stationary gear racks.

An elongated helical spring is disposed longitudinally along the vehicle frame so that the lower end of the spring abuts against the top of the rack. A cup-shaped spring retainer is longitudinally slidably mounted to the vehicle frame and entraps the upper end of the helical spring. The spring retainer, in turn, is connected to the carriage assembly by two elongated bars so that as the carriage assembly moves downwardly along the vehicle frame during the pivotal action of the foot levers, the spring retainer is pulled downwardly along the frame by the bars. As the spring retainer moves downwardly, it compresses the helical spring.

Release means are also provided for selectively disengaging the foot levers from their respective gear segments. Upon release, the foot levers no longer maintain the carriage assembly in its lower position so that the spring expands upwardly thus forcing the carriage assembly upward and provides the propulsion power for the hopping vehicle. In one form of the invention the means for disconnecting the foot levers from the gear segments is automatically actuated when the hopping vehicle contacts the ground while, in a modification of the invention, the release means is manually controlled by the operator.

As will become hereinafter more clearly apparent, the pivotal connection of the foot levers to the carriage assembly achieves a mechanical advantage which enables the operator to increase the compressive force applied to the helical spring over that obtainable by the previously known pogo sticks. This increased compression of the helical spring in turn greatly increases the hopping height and lineal distance obtainable over that obtainable by the previously known pogo sticks. Consequently, the hopping vehicle of the present invention can be used as a serious mode of transportation rather than merely an adolescent toy.

BRIEF DESCRIPTION OF THE DRAWINGS

A better understanding of the present invention will be had upon reference to the following detailed description when read in conjunction with the accompanying drawing, wherein like reference characters refer to like parts throughout several views, and in which.

DETAILED DESCRIPTION OF THE PREFERRED EMBODIMENT

Figure 1:
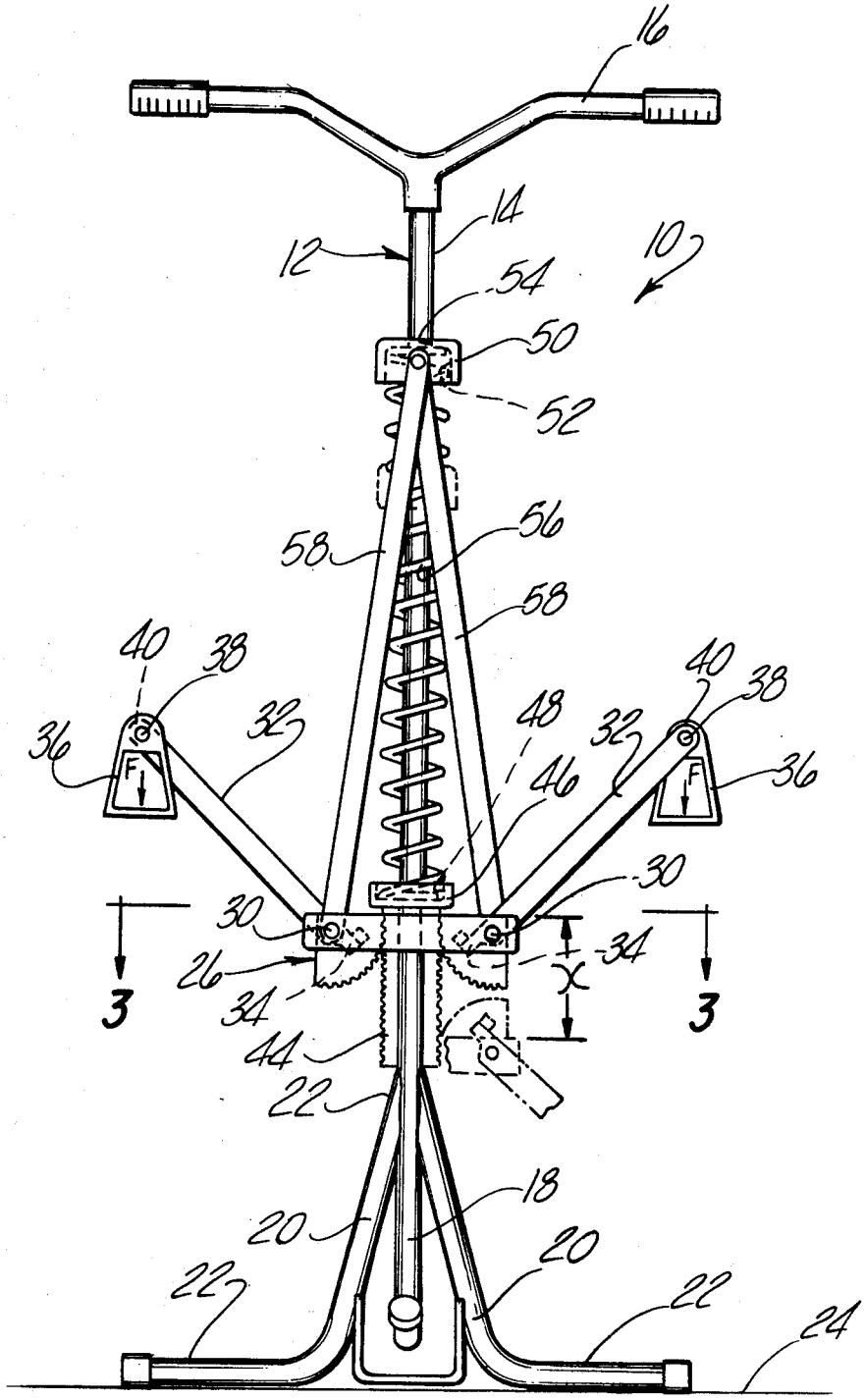
FIG. 1 is front plan view illustrating the hopping vehicle according to the present invention.
Figure 2:
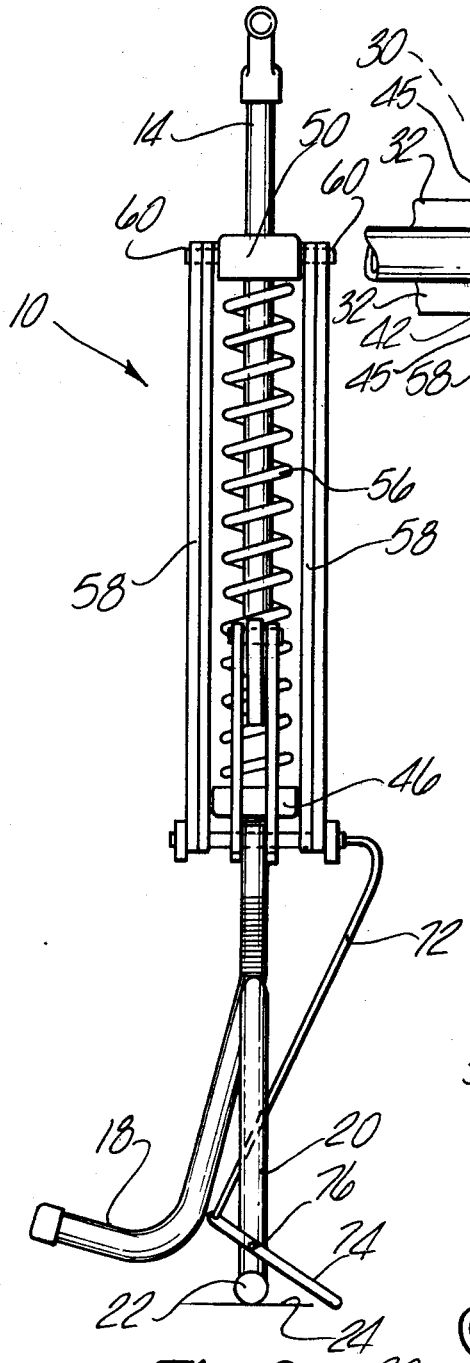
FIG. 2 is a side plan view illustrating the hopping vehicle according to the present invention.

With reference first to FIGS. 1 and 2, the hopping vehicle 10 according to the present invention is thereshown and comprises a vertically elongated frame 12 having an elongated center tube 14. A handle bar 16 secured to the upper end of the center tube 14 and the center tube 14 has a rearwardly flared portion 18 at its lower end. A pair of side support tubes 20 are secured at 21 to the center tube 14 near its lower end and each support tube 20 includes a horizontally extending portion 22 which engages and can rest upon a ground support surface 24. The side support tubes 20 in conjunction with the lower flared portion 18 of the center tube 14 enable the hopping vehicle 10 to rest upon the ground support surface 24 in a generally upright position.

Figure 3:
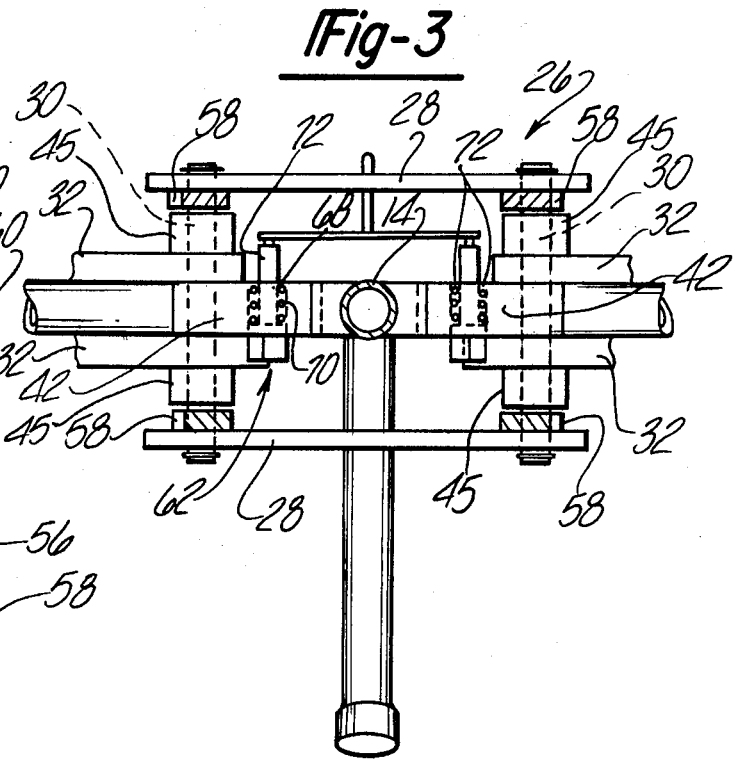
FIG. 3 is a fragmentary sectional view taken substantially along line 3—3 in FIG. 1 and with parts removed and enlarged for clarity.

With reference now to FIGS. 1 and 3, a carriage assembly 26 is longitudinally slidably mounted to the frame 12 in a manner which will become hereinafter apparent. The carriage assembly 26 includes a pair of cross members 28 disposed latterally across the frame 12 and on opposite sides of the center tube 14. The cross members 28 are secured together by a pair of shafts 30 which extend perpendicularly outward from and between the cross members 28 on opposite sides of the center tube 14.

Still referring to FIGS. 1 and 3, a pair of elongated foot levers 32 are pivotally mounted to each shaft 30 adjacent the inner end 34 of each lever 32 while a stirrup 36 is pivotally secured by a pin 38 to the outer end 40 of the levers 32. As will be subsequently described, the distance between the shaft 30 and the outer end 40 of each foot lever 32, is substantially greater than the distance between the shaft 30 and the vehicle frame 12.

Figure 4:
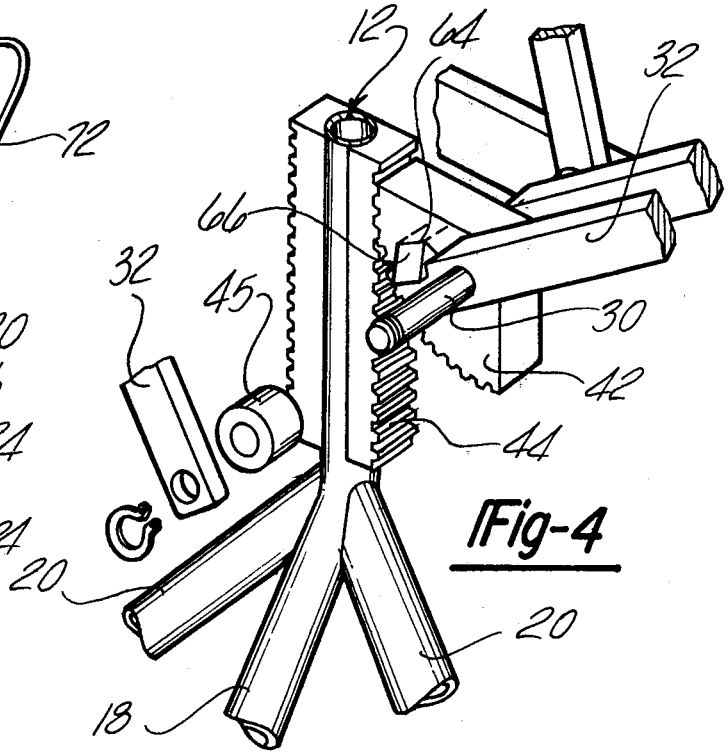
FIG. 4 is a fragmentary perspective view illustrating a portion of the hopping vehicle of the present invention and with parts removed and enlarged for clarity.

With reference now to FIGS. 3 and 4, a gear segment 42 is positioned around each of the carriage shafts 30 inbetween the foot levers 32 and is freely rotatable with respect to its associated foot lever 32. Each of the gear segments 42 in addition meshes with a gear rack 44 which is rigidly secured to the vehicle frame 12 just above the frame side supports 20. In addition, appropriate spacers 45 are mounted on each shaft 30 to prevent axial displacement of the levers 32 and gear segment 42.

With reference now to FIGS. 1 and 2, a cup-shaped spring retainer 46 having an interior cavity 48 is secured to the vehicle frame 12 above the gear racks 44. A second cup-shaped spring retainer 50 having an interior cavity 52 is also mounted to the vehicle frame 12 above the first spring retainer 46. Unlike the first spring retainer 46, however, the second spring retainer has an axial throughbore 54 through which the center tube 14 extends so that the second spring retainer 50 is longitudinally slidably mounted to the frame 12. An elongated helical spring 56 is disposed coaxially around the center tube 14 between the spring retainers 46 and 50 so that its lower end is entrapped within the spring retainer cavity 48 while its upper end is entrapped within the spring retainer cavity 52.

The slidable spring retainer 50 is secured to the vehicle carriage 26 through two pairs of elongated connecting bars 58. The connecting bars 58 are disposed on both sides of the center tube 14 and are connected at their upper end to the spring retainer 50 by pins 60. The lower end of each connecting bar 58 is connected to one of the shafts 30 (FIG. 3) so that the spring retainer 50 moves in unison with the carriage assembly.

With reference now to FIGS. 3 and 4, the hopping vehicle 10 further includes means 62 for selectively connecting each foot lever 32 to its associated gear segment 42. The means 62 further comprises a detent pin 64 having an upper inclined surface 66. One detent pin 64 is axially slidably mounted within a bore 68 in each gear segment 42 by a spring 70 and is urged so that it protrudes laterally outwardly from the gear segment 42. With the detent pin 64 in its outer position, one foot lever 32 engages the pin 64 in its respective gear segment so that the pivotal action of the levers 32 from their upper and to their lower position, illustrated in phantom line in FIG. 1, simultaneously rotates the gear segment 42 from the upper and to the lower end of the gear racks 44. The detent pins 64 are oriented in the same direction. This longitudinal travel of the gear segments 42 in turn forces the entire carriage assembly 26 longitudinally downwardly along the frame 12 for a distance "X" and likewise compresses the helical spring 56 the distance "X".

A cable 72 is provided for selectively simultaneously retracting both detent pins 64 within the bore 68 which upon retraction disconnects or decouples the foot levers 32 from their gear segments 42 and permits the gear segments 42 to rotate independently of the foot levers 32. As is best shown in FIG. 2, the cable 72 is preferably connected at its lower end to an actuating lever 74 which is pivotally secured by pins 76 to the lower end of the vehicle frame 12. The actuating lever 74 is constructed so that as the vehicle 10 contacts the ground, the lever 74 rotates about its pivot pin 76 thus retracting the detent pins 64 via the cable 72 and releasing the foot levers from their associated gear segments 32. Alternatively, however, the detent pins 64 can be manually actuated by the operator by means of the lever mechanism (not shown) connected to the cable 72 and mounted on the handle bar 16.

With reference primarily to FIG. 1, the operation of the hopping vehicle 10 according to the present invention will now be described. The operator first mounts the hopping vehicle 10 by placing a foot in each of the stirrups 36 and pivoting the foot levers 32 to their lower position illustrated in phantom line. In doing so, the carriage assembly 26 moves downwardly the distance X due to the coaction between the gear segments 42 and gear racks 44. This in turn moves the upper spring retainer 50 to the position illustrated in phantom line thus compressing the helical spring 56. Moreover, since the distance between the shafts 30 and the outer ends 40 of each foot lever 32 is greater than the distance between the shafts 30 and the gear racks 44, the operator of the vehicle 10 obtains a mechanical advantage which permits the spring 56 to have a very high stiffness constant while still permitting the operator to compress it with his own weight.

With the foot levers 32 in their lower position and, likewise, with the helical spring 56 in a state of compression, the operator leans the vehicle 10 forwardly and against the actuating lever 74. The actuating lever 74 via the cable 72 then retracts the detent pins 64 in the gear segments 42 and releases the foot levers 32 from their associated gear segments 42. When this occurs, the spring 56 longitudinally expands which forces the carriage assembly 26 upwardly along the frame 12 and provides the propulsion power for lifting the vehicle 10 upwardly from the ground 24.

Midway through the jump the operator kicks his feet upwardly which causes the inner end 34 of the foot levers 32 to slide along the inclined surface 66 of each detent pin 64 until the foot levers 32 again operatively engage the detent pins 64. When the operator again contacts the ground, he depresses the foot levers 32 to their lower position partly by the momentum of his weight and the cycle is again repeated.

Due to the mechanical advantage obtained by the foot levers and used to compress the helical spring, the hopping vehicle according to the present invention is capable of higher, and thus longer, jumps than the previously known hopping vehicles or pogo sticks. For example, the hopping vehicle 10 of the present invention is capable of jumps of over 44 inches in height whereas the previously known pogo sticks for a user having the same weight are capable of only jumping approximately 16 inches.

Having described my invention, however, many modifications thereto will become apparent to those skilled in the art to which it pertains without deviation from the spirit of the invention as defined by the scope of the appended claims.

I claim:

1. A hopping vehicle comprising an elongated frame having a lower end adapted to engage a ground support surface;

a carriage means longitudinally slidably mounted to the frame;

resilient means for urging said carriage means toward an upper end of said frame; and manually powered mechanical advantage means operable on each hop of the vehicle for moving said carriage means toward the lower end of the said frame and thereby compressing said resilient means with a force greater than the momentum of a rider on the vehicle directly applied to said resilient means.

2. The invention as defined in claim 1 and including means for releasing said moving means to thereby permit the decompression of the resilient means.

3. The invention as defined in claim 1 wherein said mechanical advantage moving means comprises a pair of elongated levers pivotally secured adjacent the inner end to the carriage assembly, foot support means secured to the other end of the levers, and means responsive to the pivotal movement of said levers for longitudinally moving said carriage assembly.

4. A hopping vehicle comprising:

an elongated frame having one end adapted to engage a supporting surface;

a carriage assembly longitudinally slidably mounted to the frame;

a pair of elongated levers;

means for pivotally securing the other end of said levers to said carriage assembly so that said levers are movable between an upper position and a lower position;

a spring retainer longitudinally slidably mounted to said frame;

elongated resilient means secured longitudinally to said frame, said resilient means abutting at one end against said spring retainer and at its other end against stop means secured to the frame; and means connected to and responsive to the pivotal movement of said levers for moving said spring retainer toward said stop means.

5. The invention as defined in claim 4 and further comprising means for selectively disconnecting said spring retainer moving means from said levers.

6. The invention as defined in claim 5 wherein said vehicle further comprises at least one gear rack secured to the frame and wherein said spring retainer moving means comprises at least one gear member in mesh with the rack, and means for connecting said gear member with at least one of said levers so that said gear is rotatably driven by said levers during pivotal movement of said levers from an upper and to a lower position.

7. The invention as defined in claim 6 wherein said spring retainer moving means further comprises an elongated bar connected at one end to said spring retainer and at its other end to the carriage assembly.

8. The invention as defined in claim 7 wherein said disconnecting means further comprises a detent pin mounted in a bore in the gear member and movable between an extended position and a retracted position wherein in said extended position said detent pin abuts against said lever so that said gear member rotates in unison with the pivotal action of said levers and wherein in said retracted position, said detent pin moves out of engagement with the lever.

9. The invention as defined in claim 8 wherein said disconnecting means further comprises an actuating lever movable between a first position and a second position, cable means for operatively connecting said actuating lever to said detent pin, wherein said actuating lever moves said detent pin from its extended and to its retracted position as said lever moves from its first and to its second position.

10. The invention as defined in claim 9 wherein said lever is secured adjacent the first mentioned end of the frame and is moved from its first and to its second position upon contact of the frame with the supporting surface.

* * * * *